US011519087B2

(12) United States Patent
Rondinone et al.

(10) Patent No.: US 11,519,087 B2
(45) Date of Patent: Dec. 6, 2022

(54) ALLOY BASED ELECTROCHEMICAL CATALYST FOR CONVERSION OF CARBON DIOXIDE TO HYDROCARBONS

(71) Applicant: UT-Battelle, LLC, Oak Ridge, TN (US)

(72) Inventors: Adam J. Rondinone, Knoxville, TN (US); Dale K. Hensley, Kingston, TN (US); Seonah Jin, Santa Cruz, CA (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

(21) Appl. No.: 17/488,884

(22) Filed: Sep. 29, 2021

(65) Prior Publication Data

US 2022/0098743 A1 Mar. 31, 2022

Related U.S. Application Data

(60) Provisional application No. 63/085,340, filed on Sep. 30, 2020.

(51) Int. Cl.
*C25B 11/089* (2021.01)
*C25B 3/03* (2021.01)
(Continued)

(52) U.S. Cl.
CPC ..... *C25B 11/089* (2021.01); *C25B 3/03* (2021.01); *C25B 3/26* (2021.01); *C25B 11/054* (2021.01); *C25B 11/065* (2021.01)

(58) Field of Classification Search
None
See application file for complete search history.

(56) References Cited

U.S. PATENT DOCUMENTS 5,051,156 A 9/1991 Scharifker et al.
5,702,836 A 12/1997 Ma et al.
(Continued)

FOREIGN PATENT DOCUMENTS

WO 2015161310 A2 10/2015
WO 2015167637 A2 11/2015
(Continued)

OTHER PUBLICATIONS

Xing et al. (Dalton Trans., 2019, 48, 1504) (Year: 2019).*
(Continued)

*Primary Examiner* — Wojciech Haske
(74) *Attorney, Agent, or Firm* — Scully, Scott, Murphy & Presser, P.C.

(57) ABSTRACT

An electrocatalyst comprising (i) carbon nanospikes and (ii) copper alloy nanoparticles containing copper and at least one noble metal and residing on and/or between the carbon nanospikes. Also disclosed herein is a method of producing the electrocatalyst. Also described herein is a method for converting carbon dioxide into hydrocarbons by use of the above-described electrocatalyst. The method for producing hydrocarbons more specifically involves contacting the electrocatalyst with an aqueous solution of a bicarbonate salt while the aqueous solution is in contact with a source of carbon dioxide, and electrically powering the electrocatalyst as a cathode at negative potential condition while the cathode is in electrical communication with a counter electrode electrically powered as an anode, to convert the carbon dioxide into hydrocarbons containing at least four carbon atoms and composed of only carbon and hydrogen.

25 Claims, 4 Drawing Sheets

(51) Int. Cl.

| | |
|---|---|
| ***C25B 3/26*** | (2021.01) |
| ***C25B 11/065*** | (2021.01) |
| ***C25B 11/054*** | (2021.01) |

(56) References Cited

U.S. PATENT DOCUMENTS

| | | | |
|---|---|---|---|
| 8,313,634 | B2 | 11/2012 | Bocarsly et al. |
| 8,871,483 | B1 | 10/2014 | Atanassov et al. |
| 2010/0126870 | A1 | 5/2010 | Istvan et al. |
| 2011/0114502 | A1 | 5/2011 | Cole et al. |
| 2012/0137664 | A1 | 6/2012 | Shawabkeh et al. |
| 2013/0048506 | A1 | 2/2013 | Chen |
| 2013/0256123 | A1 | 10/2013 | Rahman et al. |
| 2014/0239231 | A1 | 8/2014 | Masel et al. |
| 2014/0262810 | A1 | 9/2014 | Rondinone et al. |
| 2017/0314148 | A1 | 11/2017 | Rondinone et al. |
| 2018/0057950 | A1 | 3/2018 | Co et al. |
| 2019/0127866 | A1 | 5/2019 | Rondinone et al. |
| 2019/0316264 | A1 | 10/2019 | Chen et al. |

FOREIGN PATENT DOCUMENTS

| | | | |
|---|---|---|---|
| WO | 2017192515 | A1 | 11/2017 |
| WO | 2019/136018 | A2 | 7/2019 |
| WO | 2020/176575 | A1 | 9/2020 |

OTHER PUBLICATIONS

Nellaiappan et al. (ACS Catal. 2020, 10, 3658-3663) (Year: 2020).*
Lee et al. (Adv. Mater. 2018, 30, 1704717) (Year: 2018).*
Ali, I., et al., "Electrochemical Conversion of CO2 into Aqueous-phase Organic Molecules Employing a Ni-nanoparticle-modified Glassy Carbon Electrode", International Journal of Electrochemical Science, (2014), vol. 9, pp. 7198-7205; Withdrawn at authors' request.
Arzhanova, T.A., et al., "Synthesis of Copper Nanostructures by Electrodeposition," ECS Transactions, May 2, 2008, pp. 45-52, vol. 11, No. 28.
Baturina, O.A., et at, "CO2 Electroreduction to Hydrocarbons on Carbon-Supported Cu Nanoparticles", ACS Catalysis 2014, Revised Jul. 21, 2014, Published Sep. 3, 2014, pp. 3682-3695, 4.
Bhaduri, B., et al., "Preparation of Asymmetrically Distributed Bimetal Ceria (CeO2) and Copper (Cu) Nanoparticles in Nitrogen-Doped Activated Carbon Micro/Nanofibers for the Removal of Nitric Oxide (NO) by Reduction," Journal of Colloid and Interface Science, Dec. 15, 2014, pp. 218-226, vol. 436.
Gangeri, M. et al., "Fe and Pt carbon nanotubes for the electrocatalytic conversion of carbon dioxide to oxygenates", Catalysis Today, (2009), 143, pp. 57-63.
He, L., et al., "Synthesis, Characterization, and Application of Metal Nanoparticles Supported on Nitrogen-Doped Carbon: Catalysis Beyond Electrochemistry," Angewandte Chemie International Edition, Oct. 4, 2016, pp. 12582-12594, vol. 55, No. 41.
Hori, Y., et al., "Electrocatalytic process of CO selectivity in electrochemical reduction of CO2 at metal electrodes in aqueous media", Electrochimica Acta, 1994 (Accepted Nov. 26, 1993), pp. 1833-1839, vol. 39, No. 11/12.
Jain, S., et al., "Synthesis and size control of copper nanoparticles and their catalytic application", Transactions of Nonferrous Metals Society of China, 2015, pp. 3995-4000, vol. 25, No. 12.
Jurina, O.A., et al., "CO2 Electroreduction to Hydrocarbons on Carbon-Supported Cu Nanoparticles", ACS Catalysis 2014, Revised Jul. 21, 2014, Published Sep. 3, 2014, pp. 3682-3695, 4.
Luo, J., et al., "Facile one-step electrochemical fabrication of a non-enzymatic glucose-selective glassy carbon electrode modified with copper nanoparticles and graphene", Microchim Acta, 2012, pp. 485-490, vol. 177.
Manthiram, K. et al., "Enhanced Electrochemical Methanation of Carbon Dioxide with a Dispersible Nanoscale Copper Catalyst", Journal of the American Chemical Society, (2014), 136, (38), 15 pages.
Sheridan, L.B. et al., "Growth and Electrochemical Characterization of Carbon Nanospike Thin Film Electrodes", Journal of the Electrochemical Society, (2014), 161(9), pp. H558-H563.
Shwartz, M. "Stanford Scientists Discover a Novel Way to Make Ethanol Without Corn or other Plants", Stanford Report, Apr. 9, 2014, 3 pages.
Tamilvanan, A., et al., "Copper Nanoparticles: Synthetic Strategies, Properties and Multifunctional Application", International Journal of Nanoscience, 2014, Accepted Mar. 26, 2014, Published May 20, 2014, pp. 1430001-1-1430001-22, vol. 13, No. 2.
International Search Report and Writen Opinion dated Jan. 14, 2022 issued in PCT/US 21/52562, 15 pages.

* cited by examiner

ALLOY BASED ELECTROCHEMICAL CATALYST FOR CONVERSION OF CARBON DIOXIDE TO HYDROCARBONS

CROSS REFERENCE TO RELATED APPLICATION

The present application claims benefit of U.S. Provisional Application No. 63/085,340, filed on Sep. 30, 2020, all of the contents of which are incorporated herein by reference.

STATEMENT REGARDING FEDERALLY SPONSORED RESEARCH

This invention was made with government support under Prime Contract No. DE-AC05-00OR22725 awarded by the U.S. Department of Energy. The government has certain rights in the invention.

FIELD OF THE INVENTION

This invention generally relates to the field of electrocatalysis and to methods for converting carbon dioxide into useful products. The invention relates, more particularly, to electrocatalysts for converting carbon dioxide to hydrocarbons.

BACKGROUND OF THE INVENTION

A low cost, easily implemented and widely distributable means to mitigate or eliminate carbon dioxide ($CO_2$) emissions will be necessary to meaningfully address climate change. Closing the carbon cycle by utilizing $CO_2$ as a feedstock for currently used commodities, in order to replace a fossil fuel feedstock, is an important intermediate step towards a carbon-neutral future.

There has been significant interest in the electrochemical conversion of $CO_2$ to liquid hydrocarbon fuels as a means to close the carbon cycle, and to store and transport energy in a manner that could meet the demands of existing internal combustion engines. Metal-based catalysts, such as copper, platinum, iron, silver, and gold have been investigated for $CO_2$ reduction, with high Faradaic efficiencies achieved for methane conversion.

However, electrocatalysts that could effectively and efficiently reduce $CO_2$ into a desirable liquid fuel remain elusive. Although copper (Cu) is a metal catalyst known for its ability to electrochemically reduce $CO_2$, the resultant products are highly diverse. For example, Cu is capable of reducing $CO_2$ into more than 30 different products, including carbon monoxide (CO), formic acid (HCOOH), methane ($CH_4$) and ethane ($C_2H_4$). As such, by means of the conventional art, the efficiency and selectivity achieved using Cu for producing liquid fuel are too low for practical use. Generally, competing reactions limit the yield of any one liquid product to single-digit percentages. Thus, a more efficient and selective method for converting $CO_2$ into useful fuel products would represent a significant advance in the art.

SUMMARY OF THE INVENTION

In one aspect, the present disclosure is directed to an electrocatalyst that converts carbon dioxide into hydrocarbons, particularly saturated or unsaturated hydrocarbons containing at least or more than four, five, or six carbon atoms. The electrocatalyst described herein for achieving this includes carbon nanospikes (CNS) and copper alloy nanoparticles residing on and/or between the carbon nanospikes. The carbon alloy nanoparticles have an alloy composition comprising copper and at least one noble metal (e.g., palladium, platinum, rhodium, iridium, silver, and/or gold). Typically, the copper and at least one noble metal are present in the metal nanoparticles in a noble metal to copper molar ratio of 1:1 to 20:1. The carbon nanospikes may be doped with a dopant selected from nitrogen, boron, or phosphorous. Each carbon nanospike has a tip, which may be curled. In some embodiments, the tip has a width in the range of 0.5-3 nm and a length in the range of 20-100 nm.

In a first set of embodiments, the molar amount of copper is at least or more than the molar amount of the sum total of noble metal. The molar ratio of copper to noble metal may be, for example, 1:1, 1.5:1, 2:1, 2.5:1, 3:1, 3.5:1, 4:1, 4.5:1, 5:1, 6:1, 7:1, 8:1, 9:1, 10:1, or 20:1 or a molar ratio within a range bounded by any two of the foregoing ratios, e.g., 1:1-10:1, 1:1-5:1, 1:1-4:1, 1:1-3.5:1, 1:1-3:1, 1:1-2.5:1, or 1:1-2:1. Ina second set of embodiments, the molar amount of copper is less than or up to the molar amount of the sum total of noble metal. The molar ratio of noble metal to copper may be, for example, 1:1, 1.5:1, 2:1, 2.5:1, 3:1, 3.5:1, 4:1, 4.5:1, 5:1, 6:1, 7:1, 8:1, 9:1, 10:1, or 20:1, or a molar ratio within a range bounded by any two of the foregoing ratios, e.g., 1:1-10:1, 1:1-5:1, 1:1-4:1, 1:1-3.5:1, 1:1-3:1, 1:1-2.5:1, or 1:1-2:1. The molar ratio of copper to noble metal may also span across ranges in the first and second embodiments, e.g., 20:1-1:20, 10:1-1:10, or 5:1-1:5.

In another aspect, the present disclosure is directed to a method for converting carbon dioxide into hydrocarbons, particularly saturated or unsaturated hydrocarbons containing at least four or five carbon atoms and composed of only carbon and hydrogen. The method entails contacting the electrocatalyst, described above, with carbon dioxide in an aqueous solution, with the carbon dioxide in the form of a bicarbonate salt (e.g., by reaction of the carbon dioxide with a metal hydroxide), while the electrocatalyst is electrically configured as a cathode at negative potential condition. The voltage across the cathode and anode may be 2-10 volts, or in some embodiments, at least 2 volts, or within 2-4 volts, or 2-3.5 volts. More particularly, the method entails contacting the above-described electrocatalyst with an aqueous solution of a bicarbonate salt while the aqueous solution is in contact with a source of carbon dioxide, which replenishes the bicarbonate salt as the bicarbonate salt decomposes to carbon dioxide and a hydroxide salt at the surface of the electrocatalyst, and the electrocatalyst is electrically powered as a cathode and is in electrical communication with a counter electrode electrically powered as an anode, wherein the voltage across the cathode and anode may be 2-10 volts, or in some embodiments, at least 2 volts or within a range of 2 to 3.5 volts, to convert the carbon dioxide into hydrocarbons containing at least or more than four, five, or six carbon atoms.

In some embodiments, at least or more than 20, 30, 40, 50, or 60 wt % of the hydrocarbons produced contain at least four carbon atoms and are composed of only carbon and hydrogen. In some embodiments, at least or more than 20, 30, 40, 50, or 60 wt % of the hydrocarbons produced contain at least five carbon atoms and are composed of only carbon and hydrogen. In some embodiments, at least or more than 20, 30, 40, 50, or 60 wt % of the hydrocarbons produced contain at least six carbon atoms and are composed of only carbon and hydrogen. In some embodiments, hydrocarbons containing at least four or five carbon atoms are produced along with any one or more of carbon monoxide, methane, or ethane, provided that carbon monoxide, methane, and ethane are produced in a sum total amount of no more than 1 wt %, 2, wt %, 5 wt %, 10 wt %, or 20 wt %, or the foregoing species are not produced (i.e., 0 wt % of the product). In some embodiments, hydrocarbons containing at least or more than four, five, or six carbon atoms are produced in the absence of methanol or ethanol being produced. In some embodiments, hydrocarbons containing at least or more than four, five, or six carbon atoms are produced along with hydrocarbons containing four or less carbon atoms, provided that hydrocarbons containing less than four carbon atoms (or containing one, two, or three carbon atoms) are produced in a sum total amount of no more than 1 wt %, 5 wt %, 10 wt %, or 20 wt %, or hydrocarbons containing less than four carbon atoms (or containing one, two, or three carbon atoms) are not produced (i.e., 0 wt % of the product).

In another aspect, the invention is directed to a method for producing the electrocatalyst. The method generally involves growing copper alloy nanoparticles onto the carbon nanospikes, which may more specifically be, for example, on the tip of a carbon nanospike or between carbon nanospikes. In particular embodiments, the method includes providing a mat of carbon nanospikes, described above, protruding outwardly from a surface of the mat and forming copper alloy nanoparticles on and/or between the carbon nanospikes. In some embodiments, the copper alloy nanoparticles are formed by electronucleating the nanoparticles onto the carbon nanospikes, such as by immersing the carbon nanospikes in a solution containing copper and noble metal salts and applying a reducing voltage on the carbon nanospikes.

DETAILED DESCRIPTION OF THE INVENTION

Figure 1:
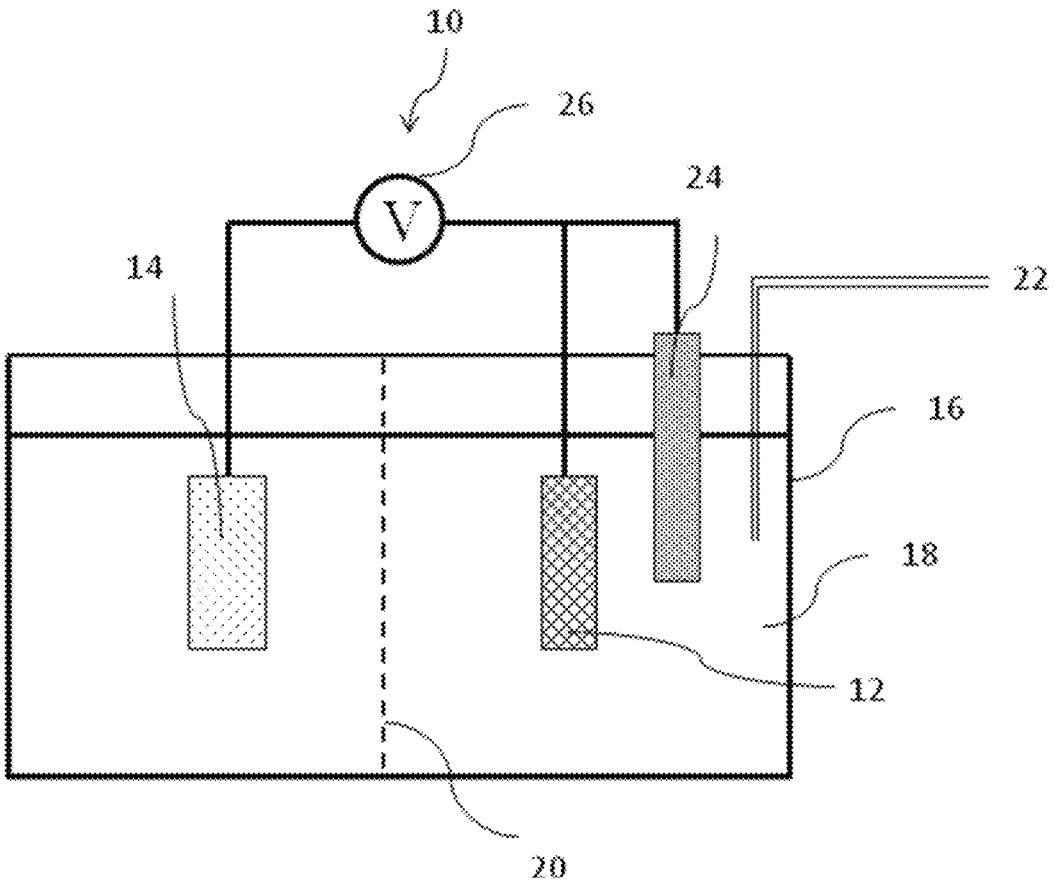
FIG. 1. A schematic diagram showing an electrochemical cell for $CO_2$ reduction.

In one aspect, the present disclosure is directed to an electrocatalyst that converts carbon dioxide into hydrocarbon compounds (i.e., "hydrocarbons"). The electrocatalyst includes carbon nanospikes (CNS) and copper alloy ("metal") nanoparticles residing on and/or between the carbon nanospikes. The copper alloy nanoparticles are substantially dispersed (i.e., unagglomerated) on the carbon nanospikes.

As used herein, the term "nanospikes" are defined as tapered, spike-like features present on a surface of a carbon film. Each carbon nanospike contains a base tapering into a tip, wherein the tip faces outwardly away from the base. In some embodiments, at least a portion (e.g. at least 30, 40, 50, 60, 70, 80, or 90%) or all (100%) of the tips are curled. In other embodiments, at least a portion (e.g. at least 30, 40, 50, 60, 70, 80, or 90%) or all (100%) of the tips are straight. The base of each carbon nanospike is attached to a planar substrate, typically carbon. The carbon nanospikes used herein are not inclusive of carbon nanotubes, nor are they inclusive of smooth- or planar-textured forms of carbon, such as glassy carbon, graphene, or graphene oxide. Thus, carbon nanotubes, glassy carbon, graphene, and graphene oxide may be excluded from the electrocatalyst.

Significantly, in the conventional art, the role of carbon supports is typically limited to supporting the active catalyst or providing electron conduction without participating in the reaction. However, this is different from the currently described carbon nanospikes, which are catalytically active entirely on their own under electrocatalytic conditions.

The carbon nanospikes can have any length or width of nanoscale size (up to or less than 1 micron or 500 nm). The length of the nanospike is measured from lowest point of the base to the highest point of the tip. In embodiments, the nanospike length is precisely or about, for example, 20, 25, 30, 35, 40, 45, 50, 55, 60, 65, 70, 75, 80, 85, 90 nm, or 100 nm, or within a range bounded by any two of these values. In particular embodiments, the carbon nanospikes have a length within a range of 20-100 nm or 50-80 nm. The width of the tip may be precisely or about, for example, 0.5, 0.6, 0.7, 0.8, 1.0, 1.1., 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, or 3 nm, or within a range bounded by any two of these values. In particular embodiments, the tip has a width within a range of 0.5-3 nm or 1.8-2.2 nm.

In some embodiments, the carbon nanospikes are doped with a dopant selected from one or more of nitrogen (N), boron (B), and phosphorous (P). The dopant may reduce or prevent ordered stacking of carbon, thus promoting the formation of a disordered nanospike structure. The dopant may also promote the conversion of carbon dioxide to hydrocarbons. In particular embodiments, the carbon nanospikes are doped with at least or only nitrogen. The amount of the dopant in the carbon nanospikes may be precisely or about, for example, 3, 4, 5, 6, 7, 8, or 9 atomic %, or within a range bounded by any two of these values. In particular embodiments, the dopant concentration is from about 4 to 6 atomic %.

The carbon nanospikes can be prepared by any method known in the art. In one embodiment, the carbon nanospikes are formed on a substrate by plasma-enhanced chemical vapor deposition (PECVD) with any suitable carbon source and dopant source. In a first embodiment, the substrate is a semiconductive substrate, in which case the resulting electrocatalyst (after nanoparticle deposition) can be said to be disposed on a semiconductive substrate. Some examples of semiconductive substrates include silicon, germanium, silicon germanium, silicon carbide, and silicon germanium carbide. In a second embodiment, the substrate is a conductive substrate, such as a metal substrate, in which case the resulting electrocatalyst (after nanoparticle deposition) can be said to be disposed on a conductive (or more specifically, metal) substrate. Some examples of metal substrates include copper, cobalt, nickel, zinc, palladium, platinum, gold, ruthenium, molybdenum, tantalum, rhodium, stainless steel, and alloys thereof. In a particular embodiment, an arsenic-doped (As-doped) silicon substrate is employed, and nitrogen-doped carbon nanospikes are grown on the As-doped silicon substrate using acetylene as the carbon source and ammonia as the dopant source. For additional details on the formation of carbon nanospikes of the present invention, reference is made to Sheridan et al., *J. of Electrochem. Society,* 2014, 161(9): H558-H563, the contents of which are herein incorporated by reference in their entirety.

The copper alloy nanoparticles are composed of at least (or only) copper and at least one noble metal, wherein the copper and at least one noble metal are homogeneously present in the nanoparticle as an alloy. The term "noble metal" generally refers to a second or third row transition metal of Groups 7, 8, 9, 10, 11, or 12 of the Periodic Table of the Elements, or more particularly, palladium (Pd), platinum (Pt), rhodium (Rh), iridium (Ir), silver (Ag), gold (Au), ruthenium (Ru), osmium (Os), and rhenium (Re). In some embodiments, the one or more noble metals are selected from palladium, platinum, rhodium, iridium, silver, and gold. In more particular embodiments, the one or more noble metals are selected from palladium and platinum. The noble metals may, in some embodiments, refer to the platinum group metals, i.e., Ru, Rh, Pd, Os, Ir, and Pt. In some embodiments, elements other than copper and one or more noble metals described above are excluded from the copper alloy nanoparticles (i.e., the alloy nanoparticles may contain solely copper and one or more of the noble metals described above). In some embodiments, the copper alloy nanoparticles are composed of at least or solely copper and palladium, or the copper alloy nanoparticles are composed of at least or solely copper and platinum.

In the copper alloy nanoparticles, copper and at least one noble metal are typically present in the nanoparticles in a copper to total noble metal molar ratio of at least or greater than 1. In a first set of embodiments, the molar amount of copper is at least or more than the molar amount of the sum total of noble metal. The molar ratio of copper to noble metal may be, for example, 1:1, 1.5:1, 2:1, 2.5:1, 3:1, 3.5:1, 4:1, 4.5:1, 5:1, 6:1, 7:1, 8:1, 9:1, 10:1, or 20:1 or a molar ratio within a range bounded by any two of the foregoing ratios, e.g., 1:1-10:1, 1:1-5:1, 1:1-4:1, 1:1-3.5:1, 1:1-3:1, 1:1-2.5:1, or 1:1-2:1. Ina second set of embodiments, the molar amount of copper is less than or up to the molar amount of the sum total of noble metal. The molar ratio of noble metal to copper may be, for example, 1:1, 1.5:1, 2:1, 2.5:1, 3:1, 3.5:1, 4:1, 4.5:1, 5:1, 6:1, 7:1, 8:1, 9:1, 10:1, or 20:1, or a molar ratio within a range bounded by any two of the foregoing ratios, e.g., 1:1-10:1, 1:1-5:1, 1:1-4:1, 1:1-3.5:1, 1:1-3:1, 1:1-2.5:1, or 1:1-2:1. The molar ratio of copper to noble metal may also span across ranges in the first and second embodiments, e.g., 20:1-1:20, 10:1-1:10, or 5:1-1:5.

The term "nanoparticles," as used herein, generally refers to particles having a size of at least 1, 2, 3, 5, 10, 20, 30, 40, or 50 nm and up to 100, 200, 300, 400, or 500 nm in at least one or two dimensions (or typically all dimensions) of the nanoparticles. In different embodiments, the copper alloy nanoparticles can have a size of precisely or about, for example 1, 2, 5, 10, 15, 20, 25, 30, 35, 40, 45, 50, 55, 60, 65, 70, 75, 80, 85, 90, 95, 100, 150, 200, 250, 300, 350, 400, 450, or 500 nm, or a size within a range bounded by any two of these values. In particular embodiments, the copper alloy nanoparticles have a size in a range of 30 to 100 nm.

The copper alloy nanoparticles can have any of a variety of shapes. In a first embodiment, the copper alloy nanoparticles are substantially spherical or ovoid. In a second embodiment, the copper alloy nanoparticles are substantially elongated, and may be rod-shaped, tubular, or even fibrous. In a third embodiment, the copper alloy nanoparticles are plate-like, with one dimension significantly smaller than the other two. In a fourth embodiment, the copper alloy nanoparticles have a substantially polyhedral shape, such as a pyramidal, cuboidal, rectangular, or prismatic shape.

The copper alloy nanoparticles can be present on the carbon nanospikes at any suitable density. A suitable density is a density that retains electrocatalyst activity. The density of the copper alloy nanoparticles on the carbon nanospikes may be precisely or about, for example, $0.1\times10^{10}$, $0.3\times10^{10}$, $0.5\times10^{10}$, $0.8\times10^{10}$, $0.9\times10^{10}$, $1.0\times10^{10}$, $1.2\times10^{10}$, $1.3\times10^{10}$, $1.4\times10^{10}$, $1.5\times10^{10}$, $1.8\times10^{10}$, $2.0\times10^{10}$, $2.5\times10^{10}$, $3.0\times10^{10}$, $3.5\times10^{10}$, $4.0\times10^{10}$, $4.5\times10^{10}$, or $5.0\times10^{10}$ particles/cm$^2$, or within a range bounded by any two of these values. In particular embodiments, the copper alloy nanoparticles are present on the carbon nanospikes in a density of from about $0.2\times10^{10}$ to $1.2\times10^{10}$ particles/cm$^2$.

The coverage of copper alloy nanoparticles on the carbon nanospikes can be any suitable amount. The coverage of copper alloy nanoparticle on the carbon nanospikes can be precisely or about, for example, 5, 10, 15, 20, 25, 30, 35, 40, 45, 50, 55, 60, 65, 70, or 75%, or a coverage within a range abounded by any two of these values. In particular embodiments, the coverage of copper alloy nanoparticles on the carbon nanospikes is about 10-20%, or more particularly, 12, 13, 14, 15, or 16%.

In another aspect, the invention is directed to methods for producing the electrocatalyst described above. Generally, the method involves depositing copper alloy nanoparticles onto a substrate composed of carbon nanospikes (i.e., CNS substrate). The copper alloy nanoparticles can be deposited on the CNS substrate using any method that results in the copper alloy nanoparticles residing on and remaining affixed to the surface of the CNS substrate after the deposition. More specifically, the process results in the copper alloy nanoparticles residing on and/or between carbon nanospikes. In some embodiments, at least a portion (e.g., at least 30, 40, 50, 60, 70, 80, or 90%) of the copper alloy nanoparticles reside at the tips of the carbon nanospikes. In some embodiments, at least a portion (e.g., at least 30, 40, 50, 60, 70, 80, or 90%) of the copper alloy nanoparticles reside between the carbon nanospikes.

In a particular embodiment, the method for depositing copper alloy nanoparticles on the carbon nanospikes is by electronucleation, such as by immersing the CNS substrate into an aqueous or non-aqueous solution containing one or more copper salts, one or more noble metal salts, and typically, one or more strong inorganic acids (e.g., sulfuric acid or nitric acid), and applying a voltage onto the CNS substrate to reduce the metal ions in the metal salt(s) to an elemental alloy of copper and noble metal, thus forming copper alloy nanoparticles on the carbon nanospikes. Some examples of copper salts that may be used include copper sulfate ($CuSO_4$), copper chloride ($CuCl_2$), copper nitrate ($Cu(NO_3)_2$), copper acetate ($Cu(CH_3COO)_2$), copper acetylacetonate ($Cu(C_5H_7O_2)_2$), copper carbonate ($CuCO_3$), copper stearate, copper ethylenediamine, copper fluoride ($CuF_2$), copper-ligand complexes, and their hydrates. Some examples of palladium salts include palladium chloride, palladium bromide, palladium acetate, palladium nitrate, palladium acetylacetonate, palladium-ligand complexes, and their hydrates. Some examples of platinum salts include platinum chloride, platinum bromide, platinum acetate, platinum nitrate, platinum acetylacetonate, platinum-ligand complexes, and their hydrates. Similar salts of other noble metals are well known in the art. In some embodiments, the metal salt solution does not contain a surfactant, ligand, capping molecule, or other surface active agent (e.g., alkylphosphonate molecules, such as tetradecylphosphonate, or alkylsulfate or alkylsulfonate molecules), in which case the resulting copper alloy nanoparticles are not coated with a surface active agent, such as any of those mentioned above.

Another advantage of the electronucleation process is that the copper alloy nanoparticles become directly attached to carbon reactive sites on the carbon nanospikes. Notably, conducting the copper electronucleation process in the presence of carbon nanospikes is responsible for the selective attachment of copper alloy nanoparticles to carbon reactive sites in the carbon nanospikes. This result cannot be achieved by depositing already-produced copper alloy nanoparticles onto carbon nanospikes. In some embodiments, an electrocatalyst prepared by depositing already-produced copper alloy nanoparticles onto carbon nanospikes (i.e., with substantially no attachment of copper alloy nanoparticles to carbon reactive sites) is substantially hindered or incapable of converting carbon dioxide to hydrocarbons, whereas an electrocatalyst containing a substantial portion of copper alloy nanoparticles in contact with carbon reactive sites in the carbon nanospikes is highly efficacious in converting carbon dioxide to hydrocarbons.

The electronucleation conditions, such as temperature, length of the voltage pulse, copper salt concentration, noble metal salt concentration, and pH, can be suitably adjusted to select for copper alloy nanoparticles of a specific size, morphology, and composition. In particular, the voltage pulse can be adjusted to select for a specific particle size, with longer pulses generally producing larger nanoparticles. In typical embodiments, the voltage pulse is no more than 10 or 5 seconds, or more particularly, no more than 1 second, or up to or less than 500, 100, or 50 microseconds, or up to or less than 1 microsecond.

In the electronucleation process, the concentration of the copper and noble metal salts in the aqueous solution can be any suitable concentration at which the electrochemical process can function to produce nanoparticles. In different embodiments, the concentration of the copper salt and noble metal salt may independently be precisely or about, for example, 10 nM, 50 nM, 100 nM, 500 nM, 1 μM, 10 μM, 100 μM, 500 μM, 1 mM, 5 mM, 10 mM, 50 mM, 100 mM, 500 mM, 0.1 M, 0.5 M, or 1M, or up to the saturation concentration of the copper salt(s) or noble metal salt(s), or the concentration of each salt is independently within a range bounded by any two of the above exemplary values. In particular embodiments, the concentration of the copper salt and noble metal salt are independently from about 1 mM to 0.1 M.

The electronucleation process entails contacting the metal salt solution (mixture of copper and noble metal salts) with the CNS substrate and subjecting the metal salt solution to a suitable potential that reduces copper ions and noble metal ions into nanoparticles containing the elemental mixture (alloy). The applied potential should be sufficiently cathodic (i.e., negative), and may be precisely or about, for example, −0.05 V, −0.1 V, −0.2 V, −0.3 V, −0.4 V, −0.45 V, −0.5 V, −0.6 V, −0.7 V, −0.8 V, −0.9 V, −1 V, −1.1 V, or −1.2 V vs. a reversible hydrogen electrode (RHE). In particular embodiments, the applied potential is from about 0.5-1.0 V.

The temperature of the electronucleation process (i.e., of the aqueous solution during the electronucleation process) can be precisely or about, for example, −10° C., −5° C., 0° C., 15° C., 20° C., 25° C., 30° C., 40° C., 45° C., 50° C., 55° C., 60° C., 65° C., 70° C., 75° C., 80° C., 85° C., 90° C., or 100° C., or a temperature within a range bounded by any two of the foregoing exemplary temperatures. In particular embodiments, the process is conducted at room or ambient temperature, which is typically a temperature of from about 18-30° C., more typically from about 20-25° C., or about 22° C.

In the electronucleation process, the pH of the aqueous solution can also be selected to help facilitate the formation of nanoparticles. The pH of the aqueous solution typically ranges from 1.5 to 6. In particular embodiments, the pH of the aqueous solution is from about 4 to 6. The pH of the aqueous solution can be adjusted by adding pH-adjusting agents, such as a strong acid (e.g., sulfuric acid) or a strong base (e.g., sodium hydroxide).

To minimize side reactions, the electronucleation process that produces the copper alloy nanoparticles is typically conducted under an inert atmosphere. The inert atmosphere may consist of, for example, nitrogen, helium, or argon gas, or combination thereof. Generally, the aqueous solution is purged with the inert gas before and/or during the electronucleation process.

Generally, the electronucleation process does not include a surfactant, capping molecule, ligand, or other surface active organic molecule, as commonly used in the art to control the nanoparticle size and/or shape. The absence of such molecules can be advantageous since such molecules may interfere with the electrocatalytic ability of the electrocatalyst. Instead of surfactants to control nanoparticle growth, the electronucleation process relies on the carbon nanospikes as nucleation points for growing copper alloy nanoparticles, and couples this with voltage pulse time to adjust the size of the nanoparticles.

The copper alloy nanoparticles may also be deposited by other means, such as physical vapor deposition (PVD) or chemical vapor deposition (CVD), any of which may also produce uncapped or uncoated (unpassivated) nanoparticles. Notably, the absence of capping or coating molecules on the copper alloy nanoparticles may significantly enhance the ability of the electrocatalyst described above to convert carbon dioxide to hydrocarbons.

In another embodiment, the method for depositing copper alloy nanoparticles on the carbon nanospikes is by adsorption of copper-containing and noble metal-containing metal-ligand complexes onto the CNS substrate and subsequent decomposition of the metal-ligand complexes. The method includes immersing the CNS substrate into a solution comprising the metal-ligand complexes, which results in absorption of the metal-ligand complexes on the surface of the CNS substrate. The decomposition of the metal-ligand complexes results in discrete copper alloy nanoparticles on the carbon nanospikes. The ligand portion of the complex may be a chelating agent, e.g., a polydentate ligand that forms two or more coordinate bonds to the metal in the complex. Some copper-containing complexes useful in the present invention include copper tartrate or copper ethylenediaminetetraacetate (EDTA). The copper and noble metal complexes can be formed prior to their addition to the solution, or they can be formed in the solution, for example, by mixing a copper salt, noble metal salt, and one or more ligands or chelating agents. In some embodiments, the solution is an aqueous solution, typically a basic solution with a pH of 10 to 13. In other embodiments, the solution includes an organic solvent, such as, for example, an alcohol (e.g., methanol or ethanol). The solution is optionally heated to a temperature at which the ligand in the copper complex is stable, e.g., to 60-70° C., to increase adsorption. After formation of the nanoparticles and removal of the CNS substrate from the solution, the CNS substrate can be further heated to decompose the metal complexes in a reducing atmosphere containing, for example, hydrogen gas, to yield the copper alloy nanoparticles deposited and bound to the CNS, and wherein the copper alloy nanoparticles preferably have surfaces free of ligands, chelating agents, capping molecules, and any other organic surface active agents. The resulting nanoparticle-containing CNS may be suitably thermally treated to remove surface-bound organic species from the nanoparticles.

In another embodiment, the method for depositing copper alloy nanoparticles on the CNS is by electroless deposition. The method includes immersing the CNS substrate in an electroless plating solution containing one or more copper and noble metal salts, one or more chelating agents, and a reducing agent. As well known in the art of electroless copper plating, copper ions from the plating solution become selectively reduced at the surface of a substrate in the solution. When applied, for the instant purposes, on a mat of carbon nanospikes, the electroless solution deposits elemental copper alloy nanoparticles on the carbon nanospikes. As well known, the chemical reduction reactions occur without the use of external electrical power. To form copper alloy nanoparticles, the electroless plating solution includes noble metal salts. The copper salt may be any of the known copper sources useful in an electroless process, e.g., copper sulfate, copper nitrate, copper chloride, or copper acetate. The noble metal salt may be analogous, such as any of those described earlier above. Some examples of chelating agents include Rochelle salt, EDTA, and polyols (e.g., Quadrol® (N,N,N',N'-tetrakis (2-hydroxypropyl)ethylenediamine)). Some examples of reducing agents include hypophosphite, dimethylaminoborane (DMAB), formaldehyde, hydrazine, and borohydride. The plating solution may additionally include a buffer (e.g., boric acid or an amine) for controlling pH and various optional additives, such as bath stabilizers (e.g., pyridine, thiourea, or molybdates), surfactants (e.g., a glycol), and wetting agents. The plating solution is typically basic. The pH of the plating solution can be adjusted, for example, by addition of sodium hydroxide (NaOH), to a pH of 10 to 13. The plating solution can be optionally heated, e.g., to a temperature of 60-80° C. The resulting nanoparticle-containing CNS may be suitably thermally treated to remove surface-bound organic species from the nanoparticles.

In yet another embodiment, the method for depositing copper alloy nanoparticles on the CNS is achieved by first producing the copper nanoparticles ex situ (i.e., when not in contact with the nanospikes), by any of the methods of nanoparticle production known in the art, followed by depositing the resulting nanoparticles on the CNS. The copper alloy nanoparticles are typically produced in solution, and the solution of copper alloy nanoparticles subsequently contacted with the carbon nanospikes followed by drying. The copper alloy nanoparticles will typically attach to the carbon nanospikes by adsorption, e.g., physisorption. The resulting nanoparticle-containing CNS may be suitably thermally treated to remove surface-bound organic species from the nanoparticles.

In another aspect, the present disclosure is directed to a method of converting $CO_2$ into hydrocarbons using the electrocatalyst described above. The method includes contacting the electrocatalyst, described above, with $CO_2$ in an aqueous solution, with the $CO_2$ in the form of a bicarbonate salt (e.g., by reaction of the carbon dioxide with a metal hydroxide), while the electrocatalyst is electrically configured as a cathode. More particularly, the method includes contacting the above-described electrocatalyst with an aqueous solution of a bicarbonate salt while the aqueous solution is in contact with a source of carbon dioxide, which replenishes the bicarbonate salt as the bicarbonate salt decomposes to $CO_2$ and/or $CO_2$ reduction products and a hydroxide salt, and the electrocatalyst is electrically powered as a cathode and is in electrical communication with a counter electrode electrically powered as an anode. A voltage is then applied across the anode and the electrocatalytic cathode in order for the electrocatalytic cathode to electrochemically convert the carbon dioxide to hydrocarbons.

The electrochemical conversion of $CO_2$ can be carried out in an electrochemical cell 10, as depicted in FIG. 1. The electrochemical cell 10 includes a working electrode (cathode) 12 containing the electrocatalyst of the present invention, a counter electrode (anode) 14, and a vessel 16. The counter electrode 14 may include a metal such as, for example, platinum or nickel. The vessel 16 contains an aqueous solution of bicarbonate 18 as the electrolyte and a source of $CO_2$. The working electrode 12 and the counter electrode 14 are electrically connected to each other and in contact with the aqueous solution 18. As shown in FIG. 1, the working electrode 12 and the counter electrode 14 can be completely immersed in the aqueous solution 18, although complete immersion is not required. The working electrode 12 and the counter electrode 14 only need to be placed in contact with the aqueous solution 18. The vessel 16 includes a solid or gel electrolyte membrane (e.g., anionic exchange membrane) 20 disposed between the working electrode 12 and the counter electrode 14. The solid electrolyte membrane 20 separates the vessel 16 into a working electrode compartment (first compartment) housing the working electrode 12 and a counter electrode compartment (second compartment) housing the counter electrode 14.

The electrochemical cell 10 further includes an inlet 22 through which carbon dioxide gas flows into the aqueous solution 18. The carbon dioxide gas is made to flow into the aqueous solution 18 at a rate that permits sufficient $CO_2$ transport to the surface of the working electrode 12 while preventing interference from gas bubbles striking the electrode surface. The flow rate of the $CO_2$ gas is generally dependent on the size of the working electrode. In some embodiments, the flow rate may be about, at least, or up to, for example, 3, 10, 30, 50, 70, 90, 100, 120, 140, 160, 180, or 200 mL $min^{-1}$, or within a range bounded by any two of these values. However, for larger scale operations using larger electrodes, the flow rate may be higher. In some embodiments, before introducing the $CO_2$ gas into the vessel 16, the $CO_2$ gas may be humidified with water by passing the gas through a bubbler to minimize the evaporation of the electrolyte. The carbon dioxide being converted may be produced by any known source of carbon dioxide. The source of carbon dioxide may be, for example, a combustion source (e.g., from burning of fossil fuels in an engine or generator), commercial biomass fermenter, or commercial carbon dioxide-methane separation process for gas wells.

In some embodiments, the electrochemical cell shown in FIG. 1 is a three-electrode cell that further includes a reference electrode 24 for the measurement of the voltage. In some embodiments, a reference electrode is not included. In a particular embodiment, a silver/silver chloride (Ag/AgCl) or reversible hydrogen electrode (RHE) is used as the reference electrode 24.

The aqueous solution 18 is formed by dissolving a bicarbonate salt in water. The bicarbonate salt is typically an alkali bicarbonate, such as potassium bicarbonate or sodium bicarbonate. The bicarbonate salt concentration may be precisely or about, for example, 0.05, 0.08, 0.1, 0.2, 0.3, 0.4, 0.5, or 0.6 M, or within a range bounded by any two of these values. In a particular embodiment, the bicarbonate concentration is from 0.1 to 0.5 M. In some embodiments, the bicarbonate salt is not originally present in the aqueous solution 18, but is formed in situ by starting with a hydroxide compound that reacts with carbon dioxide in solution to form the bicarbonate salt, e.g., KOH (in aqueous solution) reacting with $CO_2$ to form $KHCO_3$. In some embodiments, the aqueous solution 18 includes a mixture of the metal hydroxide and metal bicarbonate. Notably, at least during the reaction with carbon dioxide, the solution 18 should contain a certain level of metal hydroxide at all times as result of the breakdown of the metal bicarbonate, although the metal hydroxide should quickly react with incoming carbon dioxide to re-form the metal bicarbonate.

A negative voltage and a positive voltage are applied to the working electrode 12 and the counter electrode 14, respectively, to convert $CO_2$ to hydrocarbons containing at least or more than four, five, or six carbon atoms and composed of only carbon and hydrogen. Generally, the negative voltage (potential) applied to the working electrode 12 may be in a range of 2-10 volts, 2-8 volts, or 2-6 volts, or more particularly, about, for example, −0.5, −0.7, −0.9, −1.0, −1.2, −1.4, −1.5, −1.7, −2.0, −2.1, −2.5, −2.7, or −3.0 V with respect to a reversible hydrogen electrode (RHE), or within a range bounded by any two of these values. Notably, the potential across the electrodes depends on, inter alia, the membrane, cell potentials, anode materials, and overall configuration of the cell and testing conditions. In some embodiments, the voltage (potential) across the working electrode 12 (i.e., cathode) and the counter electrode 14 (i.e. anode) is at least 2 V, or within 2-4 V, or within 2-3.5 V, or within 2-3 V, for converting the $CO_2$ into hydrocarbons. The voltage can be applied by any method known to those skilled in the art. For example, the voltage can be applied using a potentiostat 26.

At least a portion (e.g., at least 20, 30, 40, 50, 60, 70, 80, or 90 wt %) or all of the hydrocarbons produced by the above described method contain at least or more than four, five, or six carbon atoms and typically up to eight, ten, or twelve carbon atoms and are composed of only carbon and hydrogen atoms. The hydrocarbons containing only carbon and hydrogen atoms may be saturated or unsaturated. The saturated hydrocarbons may be alkanes (linear or branched) or cycloalkanes. The unsaturated hydrocarbons may be aliphatic (e.g., alkenes) or aromatic (e.g., benzene, toluene, and xylenes). Some examples of hydrocarbons composed of only carbon and hydrogen and containing four carbon atoms include n-butane, isobutane, 1-butene, 2-butene, and cyclobutene. Some examples of hydrocarbons composed of only carbon and hydrogen and containing five carbon atoms include n-pentane, isopentane, neopentane, 1-pentene, 2-pentene, 1,3-pentadiene, cyclopentane, cyclopentene, cyclopentadiene, methylcyclobutane, and methylcyclobutene. Some examples of hydrocarbons composed of only carbon and hydrogen and containing six carbon atoms include n-hexane, isohexane (2-methylpentane), 3-methylpentane, 2,3-dimethylbutane, 2,2-dimethylbutane, 1-hexene, 2-hexene, 3-hexene, 1,3-hexadiene, 1,3,5-hexatriene, 2-methyl-1-pentene, 3-methyl-1-pentene, 4-methyl-1-pentene, 2-methyl-2-pentene, 3-methyl-2-pentene, 4-methyl-2-pentene, 2,3-dimethyl-1-butene, 3,3-dimethyl-1-butene, 2,3-dimethyl-2-butene, methylcyclopentane, 1-methylcyclopentene, 3-methylcyclopentene, 1-methylcyclopentadiene, cyclohexane, cyclohexene, cyclohexadiene, and benzene. Some examples of hydrocarbons composed of only carbon and hydrogen and containing more than six carbon atoms include n-heptane, isoheptane, 3-methylhexane, 2,2-dimethylpentane, 1-heptene, 2-heptene, methylenecyclohexane, n-octane, isooctane, 3-methylheptane, 2,2-dimethylhexane, 1-octene, 2-octene, n-nonane, isononane, n-decane, isodecane, toluene, 1,2-dimethylbenzene, 1,3-dimethylbenzene, 1,4-dimethylbenzene, 1,2-dimethylcyclohexane, and naphthalene.

In some embodiments, at least or more than 20, 30, 40, 50, or 60 wt % of the hydrocarbons produced contain at least or more than four carbon atoms and are composed of only carbon and hydrogen. In some embodiments, at least or more than 20, 30, 40, 50, or 60 wt % of the hydrocarbons produced contain at least or more than five carbon atoms and are composed of only carbon and hydrogen. In some embodiments, at least or more than 20, 30, 40, 50, or 60 wt % of the hydrocarbons produced contain at least or more than six carbon atoms and are composed of only carbon and hydrogen. For any of the foregoing embodiments, the molar amount of copper in nanoparticles of the electrocatalyst may be at least or more than the molar amount of the sum total of noble metal or the amount of copper may be less than or up to the amount of the sum total of noble metal, in accordance with the first and second embodiments disclosed earlier above. For any of the foregoing embodiments in wt % of hydrocarbons, in a first set of embodiments, the molar amount of copper is at least or more than the molar amount of the sum total of noble metal. The molar ratio of copper to noble metal may be, for example, 1:1, 1.5:1, 2:1, 2.5:1, 3:1, 3.5:1, 4:1, 4.5:1, 5:1, 6:1, 7:1, 8:1, 9:1, 10:1, or 20:1 or a molar ratio within a range bounded by any two of the foregoing ratios, e.g., 1:1-10:1, 1:1-5:1, 1:1-4:1, 1:1-3.5:1, 1:1-3:1, 1:1-2.5:1, or 1:1-2:1. Alternatively, for any of the foregoing embodiments in wt % of hydrocarbons, in a second set of embodiments, the molar amount of copper is less than or up to the molar amount of the sum total of noble metal. The molar ratio of noble metal to copper may be, for example, 1:1, 1.5:1, 2:1, 2.5:1, 3:1, 3.5:1, 4:1, 4.5:1, 5:1, 6:1, 7:1, 8:1, 9:1, 10:1, or 20:1, or a molar ratio within a range bounded by any two of the foregoing ratios, e.g., 1:1-10:1, 1:1-5:1, 1:1-4:1, 1:1-3.5:1, 1:1-3:1, 1:1-2.5:1, or 1:1-2:1. The molar ratio of copper to noble metal may also span across ranges in the first and second embodiments, e.g., 20:1-1:20, 10:1-1:10, or 5:1-1:5.

In a first set of embodiments, hydrocarbons described above containing at least or more than four, five, or six carbon atoms are produced along with carbon monoxide provided that carbon monoxide is produced in a sum total amount of no more than 1 wt %, 2, wt %, 5 wt %, 10 wt %, or 20 wt %, or carbon monoxide is not produced (i.e., 0 wt % of the product).

In a second set of embodiments, hydrocarbons described above containing at least or more than four, five, or six carbon atoms are produced along with methane provided that methane is produced in a sum total amount of no more than 1 wt %, 2, wt %, 5 wt %, 10 wt %, or 20 wt %, or methane is not produced (i.e., 0 wt % of the product).

In a third set of embodiments, hydrocarbons described above containing at least or more than four, five, or six carbon atoms are produced along with ethane and/or ethylene provided that ethane and/or ethylene is produced individually or in a sum total amount of no more than 1 wt %, 2, wt %, 5 wt %, 10 wt %, or 20 wt %, or ethane and/or ethylene are not produced (i.e., 0 wt % of the product).

In a fourth set of embodiments, hydrocarbons described above containing at least or more than four, five, or six carbon atoms are produced along with propane provided that propane is produced in a sum total amount of no more than 1 wt %, 2, wt %, 5 wt %, 10 wt %, or 20 wt %, or propane is not produced (i.e., 0 wt % of the product).

In a fifth set of embodiments, hydrocarbons described above containing at least or more than five or six carbon atoms are produced along with one or more butanes provided that butanes are produced in a sum total amount of no more than 1 wt %, 2, wt %, 5 wt %, 10 wt %, or 20 wt %, or butanes are not produced (i.e., 0 wt % of the product).

In a sixth set of embodiments, hydrocarbons described above containing at least or more than five or six carbon atoms are produced along with hydrogen provided that hydrogen is produced in an amount of no more than 1 wt %, 2, wt %, 5 wt %, 10 wt %, or 20 wt %, or hydrogen is not produced (i.e., 0 wt % of the product).

In a seventh set of embodiments, hydrocarbons containing at least or more than four, five, or six carbon atoms are produced along with one or more of carbon monoxide, methane, or ethane, provided that carbon monoxide, methane, and ethane are produced in a sum total amount of no more than 1 wt %, 2, wt %, 5 wt %, 10 wt %, or 20 wt %, or the foregoing species are not produced (i.e., 0 wt % of the product).

In an eighth set of embodiments, hydrocarbons containing at least or more than four, five, or six carbon atoms are produced along with one or more of hydrogen, carbon monoxide, methane, or ethane, provided that hydrogen, carbon monoxide, methane, and ethane are produced in a sum total amount of no more than 1 wt %, 2, wt %, 5 wt %, 10 wt %, or 20 wt %, or the foregoing species are not produced (i.e., 0 wt % of the product).

In a ninth set of embodiments, hydrocarbons described above containing at least or more than four, five, or six carbon atoms are produced along with methanol provided that methanol is produced in a sum total amount of no more than 1 wt %, 2, wt %, 5 wt %, 10 wt %, or 20 wt %, or methanol is not produced (i.e., 0 wt % of the product).

In a tenth set of embodiments, hydrocarbons described above containing at least or more than four, five, or six carbon atoms are produced along with ethanol provided that ethanol is produced in a sum total amount of no more than 1 wt %, 2, wt %, 5 wt %, 10 wt %, or 20 wt %, or ethanol is not produced (i.e., 0 wt % of the product).

In an eleventh set of embodiments, hydrocarbons containing at least or more than four, five, or six carbon atoms are produced along with methanol and ethanol provided that methanol and ethanol are produced in a sum total amount of no more than 1 wt %, 2, wt %, 5 wt %, 10 wt %, or 20 wt %, or in the absence of methanol and ethanol being produced (i.e., 0 wt % of the product).

In a twelfth set of embodiments, hydrocarbons containing at least or more than four, five, or six carbon atoms are produced along with molecules (which may be oxygen-containing molecules or hydrocarbons composed of only carbon and hydrogen) containing four or less carbon atoms, provided that the molecules containing four or less carbon atoms (or containing one to three carbon atoms) are produced in a sum total amount of no more than or less than 1 wt %, 5 wt %, 10 wt %, or 20 wt %. In some embodiments, oxygen-containing molecules containing four or less carbon atoms or three or less carbon atoms (e.g., formic acid, acetic acid, propionic acid, butyric acid, formaldehyde, carbon monoxide, acetone, diethyl ether, tetrahydrofuran, methanol, ethanol, n-propanol, and isopropanol) are produced in a sum total amount of no more than or less than 1 wt %, 5 wt %, 10 wt %, or 20 wt %. In some embodiments, hydrocarbons containing less than four carbon atoms (e.g., methane, ethane, ethylene, propane, and propylene) are produced in a sum total amount of no more than or less than 1 wt %, 5 wt %, 10 wt %, or 20 wt %. In a further embodiment, molecules containing four or less carbon atoms (or containing one to three carbon atoms) are not produced (i.e., 0 wt % of the product). In some embodiments, the method converts carbon dioxide solely to hydrocarbons containing at least or more than four, five, or six carbon atoms.

For any of the foregoing first to twelfth sets of embodiments, the molar amount of copper in nanoparticles of the electrocatalyst may be at least or more than the molar amount of the sum total of noble metal or the amount of copper may be less than or up to the amount of the sum total of noble metal, in accordance with the first and second embodiments disclosed earlier above. For any of the foregoing first to twelfth sets of embodiments, in a first set of embodiments, the molar amount of copper is at least or more than the molar amount of the sum total of noble metal. The molar ratio of copper to noble metal may be, for example, 1:1, 1.5:1, 2:1, 2.5:1, 3:1, 3.5:1, 4:1, 4.5:1, 5:1, 6:1, 7:1, 8:1, 9:1, 10:1, or 20:1 or a molar ratio within a range bounded by any two of the foregoing ratios, e.g., 1:1-10:1, 1:1-5:1, 1:1-4:1, 1:1-3.5:1, 1:1-3:1, 1:1-2.5:1, or 1:1-2:1. Alternatively, for any of the foregoing first to twelfth sets of embodiments, in a second set of embodiments, the molar amount of copper is less than or up to the molar amount of the sum total of noble metal. The molar ratio of noble metal to copper may be, for example, 1:1, 1.5:1, 2:1, 2.5:1, 3:1, 3.5:1, 4:1, 4.5:1, 5:1, 6:1, 7:1, 8:1, 9:1, 10:1, or 20:1, or a molar ratio within a range bounded by any two of the foregoing ratios, e.g., 1:1-10:1, 1:1-5:1, 1:1-4:1, 1:1-3.5:1, 1:1-3:1, 1:1-2.5:1, or 1:1-2:1. The molar ratio of copper to noble metal may also span across ranges in the first and second embodiments, e.g., 20:1-1:20, 10:1-1:10, or 5:1-1:5. Moreover, any of the foregoing first to twelfth sets of embodiments coupled with any of the molar ratios provided above may be further independently combined with any of the embodiments provided above for the CNS, the copper alloy nanoparticles, and methods of producing the CNS and copper alloy nanoparticles.

The electrocatalyst of the present invention generally exhibits a higher selectivity for $CO_2$ electroreduction than $H_2$ evolution, with a subsequent high Faradaic efficiency in producing hydrocarbons containing at least or more than four, five, or six carbon atoms. In some embodiments, $CO_2$ is reduced to produce hydrocarbons in primary abundance. As noted above, other species, such as hydrogen, methane, carbon monoxide, methanol, ethanol, formic acid, or acetic acid, may be produced in much lower abundance or not produced at all. Generally, the electrocatalytic process according to the invention advantageously produces hydrocarbons containing at least four, five, or six carbon atoms with no ethane or ethylene being produced. The hydrocarbons may be produced in a yield of at least 30%, 40%, 50%, 60%, 65%, 70%, 75%, or 80% relative to the total products produced, as measured by electron current. Thus, other remaining species, such as hydrogen, methane, and carbon monoxide, may be produced individually or in sum total amount not exceeding 40%, 35%, 30%, 25%, or 20%.

Without wishing to be bound by theory, the high efficiency in producing hydrocarbons may result both from an increase in the intrinsic $CO_2$ reduction activity of copper and from a synergistic interaction between copper alloy nanoparticles and neighboring carbon nanospikes. More specifically, in a first stage, $CO_2$ may initially be reduced at the sharp tips of the carbon nanospikes to carbon monoxide (CO). In a second stage, CO may then bind to the Cu/Pd alloy nanoparticle, where it is able to react with other CO molecules to form an oligomer. In a third stage, the oligomer may be electrochemically reduced to hydrocarbons containing at least or more than four, five, or six carbon atoms and containing only carbon and hydrogen.

The electrocatalyst of the present invention can advantageously operate at room temperature and in water, and can be simply turned on and off. Electrolytic syntheses achieved by the electrocatalyst of the present invention may provide a more direct, rapidly switchable and easily implemented route to distributed liquid fuel production powered by variable renewable energy sources, such as wind and solar.

In some embodiments, the $CO_2$ is converted into hydrocarbons that are deuterated. The deuterated hydrocarbons may contain a portion or all of its hydrogen atoms replaced with deuterium atoms. Some examples of partially deuterated forms of hydrocarbons include 1,1,1,2,2-pentafluoropentane, 2,2,3,3,4,4-hexafluoropentane, and 1,2-difluorocyclohexane. Some examples of fully deuterated forms of hydrocarbons include perfluorobutane, perfluoropentane, perfluorohexane, and perfluorocyclohexane. Deuterated hydrocarbon can be formed by, for example, dissolving the carbon dioxide in heavy water (deuterium oxide, $D_2O$ which is preferably at least or above 95, 96, 97, 98, 99, 99.5, 99.8, or 99.9 atom % D $D_2O$) instead of water ($H_2O$), and/or using deuterated bicarbonate salts, such as $KDCO_3$ in place of $KHCO_3$, as needed, in the aqueous solution 18.

Examples have been set forth below for the purpose of illustration and to describe certain specific embodiments of the invention. However, the scope of this invention is not to be in any way limited by the examples set forth herein.

EXAMPLES

Preparation of Carbon Nanospikes

Carbon nanospikes (CNS) were synthesized using a plasma-enhanced CVD process. An N-doped silicon substrate was plasma etched using only ammonia ($NH_3$) for 30 seconds in the plasma at 650° C. After 30 seconds, acetylene was added to the plasma to start depositing CNS, and CNS were grown for 30 minutes. The CNS is typically substantially hydrophobic with a deionized water contact angle above 100 degrees, in contrast to graphite or glassy carbon, which are more hydrophilic. In some embodiments, the CNS has a deionized water contact angle exceeding 120 degrees.

In some experiments, the CNS were grown on n-type 4-inch Si wafers <100> with As doping (<0.005Ω) via PECVD in the presence of acetylene ($C_2H_2$) and ammonia ($NH_3$) at 650° C. for 30 minutes. DC plasma was generated between the wafer (cathode) and the showerhead (anode) in a continuous stream of $C_2H_2$ and $NH_3$ gas, flowing at 80 sccm and 100 sccm, respectively. The total pressure was maintained at 6 Torr with a plasma power of 240 W.

A Cu wire was connected on the upper edge side of a cleaved CNS/Si wafer after scratching off the CNS layer near the edge. The Cu wire contact and all the edges and backside of the CNS/Si were insulated except about 0.6 $cm^2$ area of CNS surface. The insulated surface was covered by a thermal plastic attachment at about 120° C. in argon filled chamber.

The carbon nanospikes were characterized as a dense nanotextured carbon film terminated by randomly oriented nanospikes approximately 50-80 nm in length, where each nanospike consists of layers of puckered carbon ending in a ~2 nm wide curled tip Raman spectra indicated that carbon nanospikes have similar structure to disordered, multilayer graphene. XPS indicated nitrogen doping density as 5.1±0.2 atomic %, with proportions of pyridinic, pyrrolic (or piperidinic) and graphitic nitrogens of 26, 25 and 37% respectively, with the balance being oxidized nitrogen.

Synthesis Example 1

Peparation of Cu-Pd/CNS Electrocatalyst (Synthesized Using Solutions Containing 1:1 Molar Cu:Pd)

The synthesis example 1 electrode was prepared using the CNS prepared above. The CNS was immersed into an aqueous solution containing Pd and Cu metal precursors dissolved in acidic solution (25 mM $CuSO_4$/25 mM $Na_2PdCl_4$/0.5M $H_2O_4$) after Ar purging. Pd and Cu were deposited on the CNS under −0.5V potential (vs. Ag/AgCl reference) for 0.5 sec.

Synthesis Example 2

Preparation of Cu-Pd/CNS Electrocatalyst (Synthesized Using Solutions Containing 3:1 Molar Cu:Pd)

The synthesis example 2 electrode was prepared using the same synthesis procedure as described above for the synthesis example 1 electrode except that the aqueous solution contained 37.5 mM $CuSO_4$/12.5 mM $Na_2PdCl_4$/0.5M $H_2SO_4$ to provide the 3:1 molar Cu:Pd ratio.

Synthesis Example 3

Preparation of Cu-Pd/CNS Electrocatalyst (Synthesized Using Solutions Containing 6:1 Molar Cu:Pd)

Synthesis example 3 electrode was prepared using the same synthesis procedure as described above for the synthesis example 1 electrode except that the aqueous solution contained 42.86 mM $CuSO_4$/7.14 mM $Na_2PdCl_4$/0.5M $H_2SO_4$ to provide the 6:1 molar Cu:Pd ratio.

Figure 2:
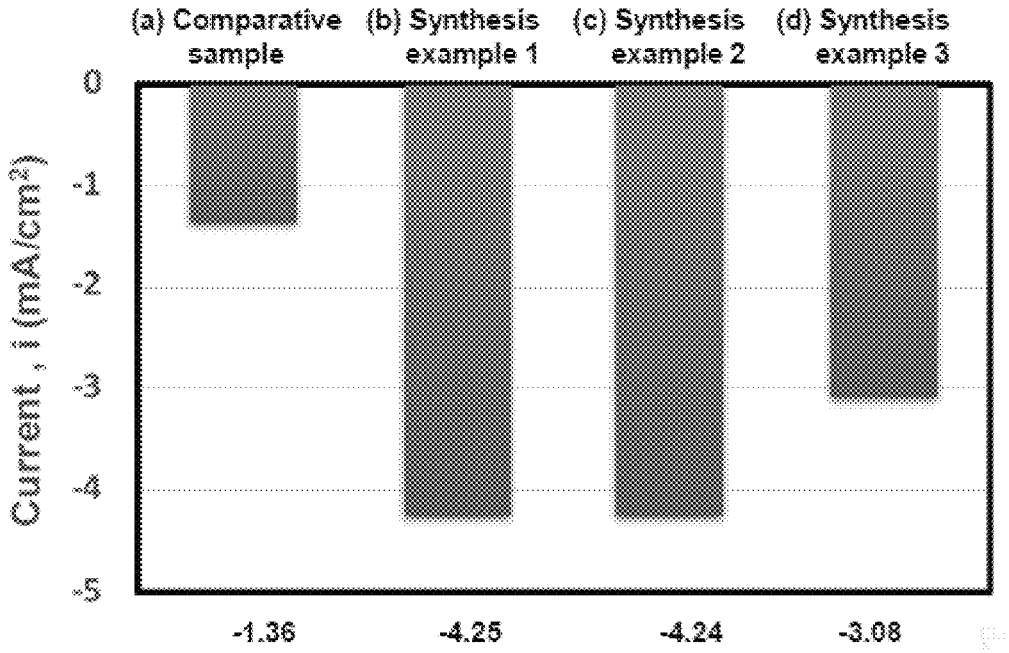
FIG. 2 is a bar graph showing chronoamperometric test results of CNS (denoted as "comparative example") and electrocatalysts prepared according to Synthesis Examples 1-3 (synthesized using solutions containing 1:1 molar Cu:Pd, 3:1 molar Cu:Pd, and 6:1 molar Cu:Pd, respectively). Results shown are at −1.1V (RHE) for 2 hours.

FIG. 2 is a bar graph showing chronoamperometric test results of CNS (denoted as "comparative example") and electrocatalysts prepared according to Synthesis Examples 1-3 (1:1 molar Cu:Pd, 3:1 molar Cu:Pd, and 6:1 molar Cu:Pd, respectively). As shown, all of the PdCu bimetallic catalysts supported on CNS at −1.1V (RHE) for 2 hours have higher current density than CNS alone under same conditions.

Figure 3:
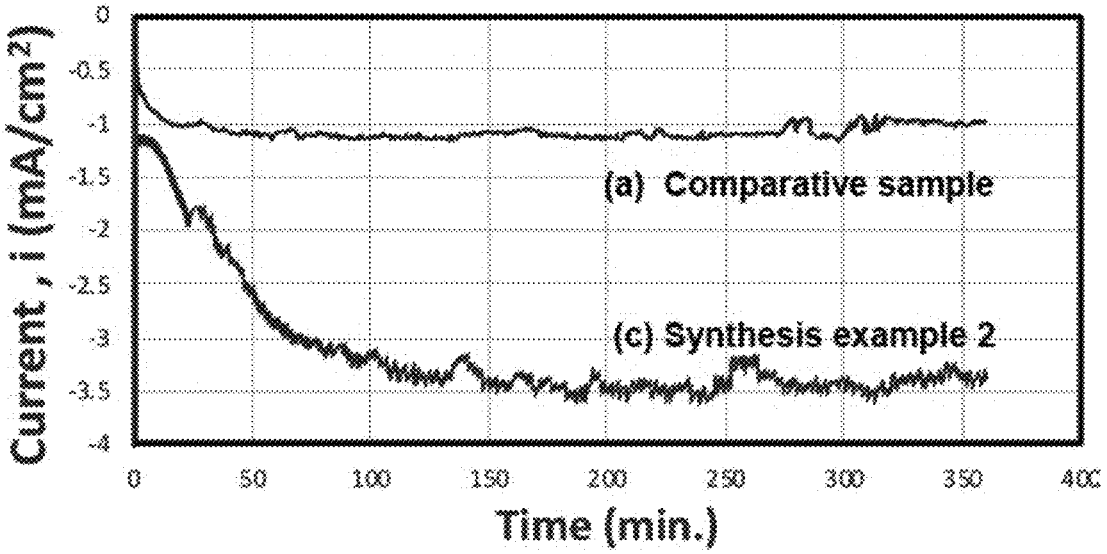
FIG. 3 is a graph showing chronoamperometric test results of CNS (denoted as "comparative example") and electrocatalyst prepared according to Synthesis Example 2 (synthesized using solutions containing 3:1 molar Cu:Pd, i.e., $Cu_3Pd$ or $PdCu_3$). Results shown are at −1.1V (RHE) for 6 hours.

FIG. 3 is a graph showing chronoamperometric test results of CNS (denoted as "comparative example") and electrocatalyst prepared according to Synthesis Example 2 (synthesized using solutions containing 3:1 molar Cu:Pd, i.e., $Cu_3Pd$ or $PdCu_3$). Results shown are at −1.1V (RHE) for 6 hours. The higher current of Synthesis Example 2 demonstrates 1) stability of the catalyst system, and 2) that the majority of current passing through the catalyst is passing through the Cu:Pd nanoparticles imbedded within the CNS.

Table 1 below shows XPS composition for CNS (denoted as "comparative example") and electrocatalyst prepared according to Synthesis Example 2 (synthesized using solutions containing 3:1 molar Cu:Pd, i.e., $Cu_3Pd$ or $PdCu_3$).

TABLE 1

XPS composition CNS and Synthesis Example 2 (synthesized using solutions containing 3:1 molar Cu:Pd)

| Surface Composition (at. %) | C | O | N | Pd | Cu | F | S | Cl |
|---|---|---|---|---|---|---|---|---|
| Comparative sample | 90.5 | 4.6 | 4.7 | 0 | 0 | 0.3 | 0.1 | 0 |
| Synthesis example 2 | 72.2 | 3.8 | 4.0 | 16.7 | 0.7 | 1.7 | 0.6 | 4.0 |

Figure 4:
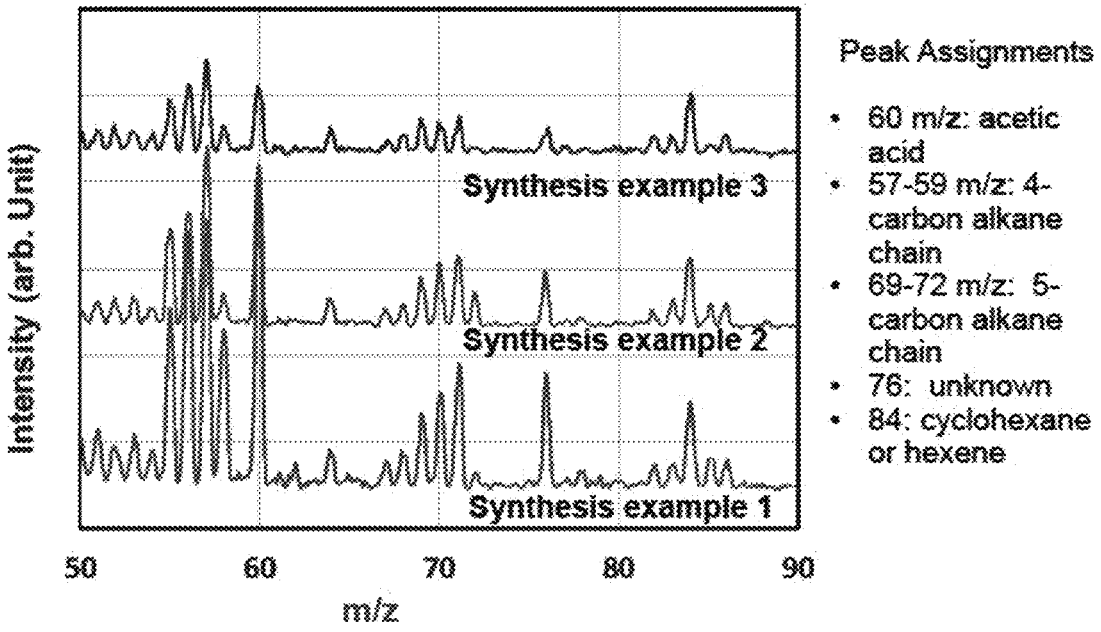
FIG. 4 presents mass spectrographs of electrocatalysts prepared according to Synthesis Examples 1-3 (synthesized using solutions containing 1:1 molar Cu:Pd, 3:1 molar Cu:Pd, and 6:1 molar Cu:Pd, respectively).

FIG. 4 presents mass spectrographs of electrocatalysts prepared according to Synthesis Examples 1-3 (Nanoparticles synthesized using solutions with compositions of 1:1 molar Cu:Pd, 3:1 molar Cu:Pd, and 6:1 molar Cu:Pd, respectively). Notably, solutions containing Pd:Cu at 1:1, 1:3, and 3:1 molar ratios were used for preparation of the electrocatalyst. Pd and Cu reduction standard potentials are different; thus, the Pd:Cu ratio of the catalysts are not the same as the initial ratio in solution. These mass spectra indicate the presence of $C_{4+}$ products including cyclohexane or hexane, along with $C_4$ and $C_5$ alkyl fragments suggesting a minimum of $C_{4+}$ product formation.

While there have been shown and described what are at present considered the preferred embodiments of the invention, those skilled in the art may make various changes and modifications which remain within the scope of the invention defined by the appended claims.

What is claimed is:

1. A method of converting carbon dioxide to hydrocarbons, the method comprising contacting an electrocatalyst with an aqueous solution of a bicarbonate salt while said aqueous solution is in contact with a source of carbon dioxide, which replenishes said bicarbonate salt as said bicarbonate salt decomposes to carbon dioxide and a hydroxide salt at a surface of said electrocatalyst, and said electrocatalyst is electrically powered as a cathode operated at negative potential condition and is in electrical communication with a counter electrode electrically powered as an anode, to convert said carbon dioxide into said hydrocarbons, wherein said hydrocarbons contain at least four carbon atoms and are composed of only carbon and hydrogen;

wherein said electrocatalyst comprises (i) carbon nanospikes, with each nanospike containing a tip, and (ii) metal nanoparticles residing on and/or between said carbon nanospikes, wherein said metal nanoparticles have an alloy composition comprising copper and at least one noble metal.

2. The method of claim 1, wherein said carbon nanospikes are doped with a dopant selected from the group consisting of nitrogen, boron, and phosphorous.

3. The method of claim 1, wherein said noble metal is selected from the group consisting of palladium, platinum, rhodium, iridium, silver, and gold.

4. The method of claim 1, wherein said noble metal is palladium or platinum.

5. The method of claim 1 wherein at least a portion of the tips are curled.

6. The method of claim 1, wherein said tip has a width within a range of 0.5 nm to 3 nm.

7. The method of claim 1, wherein said carbon nanospikes have a length within a range of 20 nm to 100 nm.

8. The method of claim 1, wherein said electrocatalyst is disposed on a semiconductive substrate or a conductive substrate.

9. The method of claim 1, wherein said metal nanoparticles have a size within a range of 1 nm to 500 nm.

10. The method of claim 1, wherein said hydrocarbons are produced along with any one or more of carbon monoxide, methane, or ethane, provided that carbon monoxide, methane, and ethane are produced in a sum total amount of no more than 20 wt %.

11. The method of claim 10, wherein carbon monoxide, methane, and ethane are produced in a sum total amount of no more than 10 wt %.

12. The method of claim 10, wherein carbon monoxide, methane, and ethane are produced in a sum total amount of no more than 5 wt %.

13. The method of claim 10, wherein carbon monoxide, methane, and ethane are produced in a sum total amount of no more than 1 wt %.

14. The method of claim 1, wherein said hydrocarbons are produced in the absence of producing carbon monoxide, methane, and ethane.

15. The method of claim 1, wherein said hydrocarbons are produced in the absence of methanol or ethanol being produced.

16. The method of claim 1, wherein said hydrocarbons containing at least four carbon atoms are produced along with molecules containing less than four carbon atoms, provided that molecules containing less than four carbon atoms are produced in a sum total amount of no more than 20 wt %.

17. The method of claim 1, wherein said hydrocarbons containing at least four carbon atoms are produced along with molecules containing less than four carbon atoms, provided that molecules containing less than four carbon atoms are produced in a sum total amount of no more than 10 wt %.

18. The method of claim 1, wherein said hydrocarbons containing at least four carbon atoms are produced along with molecules containing less than four carbon atoms, provided that molecules containing less than four carbon atoms are produced in a sum total amount of no more than 5 wt %.

19. The method of claim 1, wherein said hydrocarbons containing at least four carbon atoms are produced in the absence of molecules containing less than four carbon atoms.

20. The method of claim 1, wherein said copper and at least one noble metal are present in the metal nanoparticles in a noble metal to copper molar ratio of 1:1 to 20:1 or a copper to noble metal molar ratio of 1:1 to 20:1.

21. The method of claim 1, wherein at least 40 wt % of said hydrocarbons contain at least four carbon atoms.

22. The method of claim 1, wherein at least 50 wt % of said hydrocarbons contain at least four carbon atoms.

23. The method of claim 1, wherein at least 40 wt % of said hydrocarbons contain at least five carbon atoms.

24. The method of claim 1, wherein at least 50 wt % of said hydrocarbons contain at least five carbon atoms.

25. The method of claim 1, wherein said electrocatalyst is housed in a first compartment of an electrochemical cell, wherein said first compartment contains said aqueous solution in contact with said electrocatalyst; said counter electrode is housed in a second compartment of said electrochemical cell, wherein said second compartment also contains said aqueous solution, and said first compartment and second compartment are separated by a solid electrolyte membrane.

* * * * *